US008800064B2

(12) United States Patent
Delija

(10) Patent No.: US 8,800,064 B2
(45) Date of Patent: Aug. 12, 2014

(54) MEN'S BRIEFS WITH SEPARATE SPACE FOR PENIS

(71) Applicant: Frane Delija, Split (HR)

(72) Inventor: Frane Delija, Split (HR)

( * ) Notice: Subject to any disclaimer, the term of this patent is extended or adjusted under 35 U.S.C. 154(b) by 0 days.

(21) Appl. No.: 13/751,955

(22) Filed: Jan. 28, 2013

(65) Prior Publication Data

US 2013/0139302 A1 Jun. 6, 2013

Related U.S. Application Data

(63) Continuation of application No. PCT/HR2010/000025, filed on Jul. 27, 2010.

(51) Int. Cl.
*A41B 9/02* (2006.01)

(52) U.S. Cl.
USPC ..... 2/403; 2/405

(58) Field of Classification Search
CPC ..... A41B 9/02; A41B 9/023; A41B 9/026
USPC ..... 2/403, 401, 405, 400, 404, 228, 234, 2/238, 78.1, 78.2, 78.3, 408; 602/67, 68, 602/69, 70, 71
See application file for complete search history.

(56) References Cited

U.S. PATENT DOCUMENTS

| | | | | |
|---|---|---|---|---|
| 4,195,630 | A * | 4/1980 | Connery et al. | 602/67 |
| 4,377,008 | A * | 3/1983 | Jung | 2/403 |
| 4,414,971 | A * | 11/1983 | Chung | 602/67 |
| 4,759,355 | A * | 7/1988 | Thrower | 602/67 |
| 5,716,350 | A * | 2/1998 | Ryan | 604/385.09 |
| 5,870,779 | A * | 2/1999 | Heron | 2/403 |
| 5,875,495 | A * | 3/1999 | Thrower | 2/403 |
| 6,038,703 | A * | 3/2000 | Chung | 2/403 |
| 6,901,607 | B1 * | 6/2005 | Elwell | 2/403 |
| 7,024,703 | B1 * | 4/2006 | Della Ratta | 2/403 |
| 2004/0006812 | A1 * | 1/2004 | Truong et al. | 2/403 |
| 2006/0000008 | A1 * | 1/2006 | Chong | 2/403 |
| 2011/0154560 | A1 * | 6/2011 | Hoffman | 2/405 |
| 2012/0260404 | A1 * | 10/2012 | Steele | 2/404 |

FOREIGN PATENT DOCUMENTS

| | | | |
|---|---|---|---|
| EP | 0230102 | A2 | 7/1987 |
| JP | 2002088503 | A | 3/2002 |
| WO | 2004089128 | A1 | 10/2004 |
| WO | 2008085113 | A1 | 7/2008 |
| WO | 2009147458 | A1 | 12/2009 |

OTHER PUBLICATIONS

International Search Report Application No. PCT/HR2010/00025 Completed: Mar. 9, 2011; Mailing Date: Mar. 16, 2011 4 pages.

* cited by examiner

*Primary Examiner* — Amy Vanatta
(74) *Attorney, Agent, or Firm* — St. Onge Steward Johnston & Reens LLC

(57) ABSTRACT

Men's briefs, said briefs having a separated space located in a forward portion thereof, said separated space comprised of an inner insert and an outer insert, said inner insert including two overlapping parts forming a generally circular orifice sized to permit a wearer to position a wearer's penis into the separated space. The orifice is formed from two overlapping fabric parts having curved elastic hems, and is slidably positionable across the front of the briefs midline by sliding the inner insert.

10 Claims, 4 Drawing Sheets

MEN'S BRIEFS WITH SEPARATE SPACE FOR PENIS

FIELD OF THE INVENTION

The invention relates to men's underwear, in particular men's underpants.

BACKGROUND OF THE INVENTION

Men's penis and testicles are constantly in contact, which is undesirable from hygienic and health points of view. Particularly in warm weather they may become sweaty, and drops of urine remaining after urination may coat the organs, both contributing to unhygenic conditions. Furthermore, contact and rubbing of the penis on the testicles can warm the testicles contributing to sterility problems. Briefs clinging tightly to the body also cause unpleasant constricting of the penis and the testicles.

Presently there are many men's brief designs known, with or without legs, made to cling against the body or not. The above problems are manifest in all the existing brief designs, because they have no separate space to receive the penis.

Document WO2009147458A1 discloses men's briefs with a separate space for the penis where the separate space for penis has large U-shape opening located symmetrically relative to the brief midline. The space consists of two physically separated spaces 7 divided by seams 6 and 4.

SUMMARY OF THE INVENTION

The technical problem that is solved by this invention relates to designing of men's briefs where the penis will be physically separated from the testicles, where it will always stay in the falling position, and where constriction of the penis and the testicles will be minimized. The men's briefs with separate space for the penis, according present invention, make a very useful part of underwear, aimed to the man's health, that can be manufactured very economically and in numerous embodiments. It includes essential improvements relative to previously known briefs of this type.

In particular, the present invention is directed at men's briefs with a separate space for the penis placed at the inner side of the front part of the briefs.

The present invention differs from WO2009147458A1 in that it discloses men's briefs with one separate space for the penis. Another difference between present invention and WO2009147458A1 is the form of the opening for receiving penis. According to present invention opening has circular like shape which encircles the penis in a way that prevents its falling out from separated space, and furthermore present invention provides elastic means for adjustably tightening of the penis. A further advantage of the present invention is that the orifice is placed to the side of the brief's midline, left or right, depending of the customer preferences.

Two separate spaces of WO2009147458A1 are not necessary since single one fulfils all requirements and further simplifies fabrication and accordingly lowers the fabrication costs. The U-shaped opening of WO2009147458A1 has showed certain deficiencies in use, such as falling out of penis from separate space and pressure on penis caused by pants. The present invention with above mentioned orifice shifted left or respectively right by about 1.50 to 2.00 cm together with inner insert formed from two overlapping parts provides encircling of the penis in a more healthy, hygienic and comfortable way. Accordingly, briefs according to the present invention are more pleasant. Since, as a matter of general knowledge, penis is naturally slightly directed to the left or right side, the present invention provides such natural position avoiding any pressure caused by pants. On the other hand, the overlapping inner insert prevents falling out of penis from the brief's separate space, especially during long-lasting sitting position.

In accordance with the invention, men's briefs have a separated space for a penis, and can have short or long legs, and have a flexible belt, and a panel (front outer insert and front inner insert), wherein a separated space for penis is formed by front outer insert and front inner insert; the inserts are connectable to the panel and optional part in a manner to form men's briefs, wherein front inner insert has shape and dimensions same as front outer insert. The front inner insert is formed from two overlapping sewed parts having curved hems, where curved hems form a generally circular shaped adjustable orifice for inserting the penis into separated space. The adjustable orifice is placed aside from briefs midline, and where the orifice encircles the penis in a way that prevents its falling out from separated space. The adjustable orifice is placed left or right aside from brief's midline by rotating front inner insert by 180° around the brief's midline. Additionally said hems have elastic means for adjustably encircling the penis, where, according to one embodiment of present invention, said elastic means can be tightened by the means on the outer side of the briefs. The shape of the opening for entering the penis and the height at which it is made are adjusted to allow the penis to smoothly enter its separate space when the briefs are being put on. This way, the testicles remain in their normal position, always physically separated from the penis.

BRIEF DESCRIPTION OF THE DRAWINGS

Invention will be below described in detail with reference to drawings where.

DETAILED DESCRIPTION OF THE INVENTION

Figure 6A:
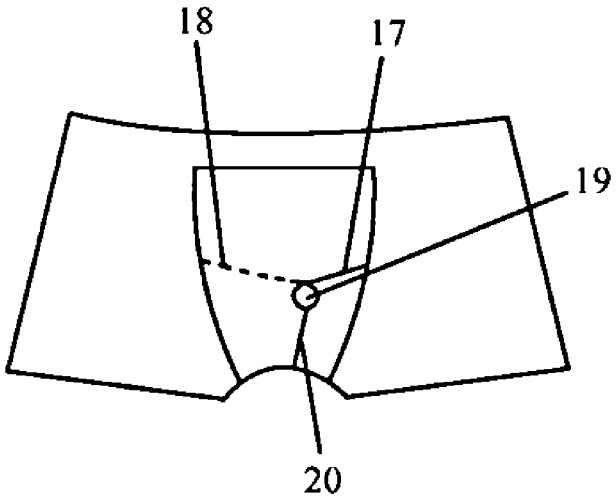
FIG. 6*a* shows view of the inner front side of the briefs according to the one embodiment of the invention.
Figure 6B:
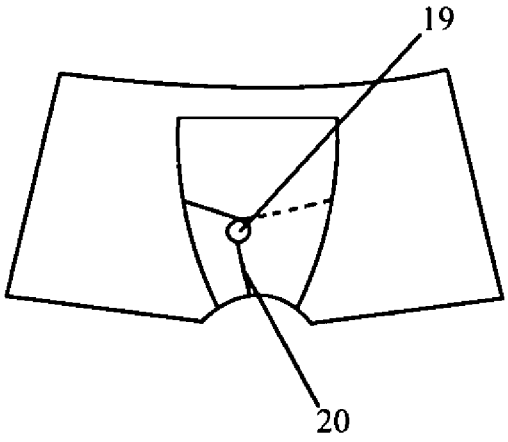
FIG. 6*b* shows view of the inner front side of the briefs according to the another embodiment of the invention.

With reference to FIGS. 1 to 3, 5*a* and 5*b*, men's briefs with a separated space for penis, made as short or long leg briefs, with flexible belt, panel (A), front outer insert (B) and front inner insert (B'), wherein separated space for penis is formed by front outer insert (B) and front inner insert (B'); the inserts (B) and (B') being connectable to the panel (A) and optional part (3) in a manner to form men's briefs, wherein front inner insert (B') has shape and dimensions same as front outer insert (B). Front inner insert (B') is formed from two overlapping sewed parts (C) and (D) having curved hem 17 and respectively hem 18, where curved hems 17 and 18 form circular like adjustable orifice 19 for inserting penis into separated space. As illustrated on FIGS. 5*a* and 5*b*, according to the embodiment of the invention, it is provided that part (C) overlaps part (D) or respectively, part (D) overlaps part (C), without any further modification of said parts (C) and (D) and other parts of briefs. FIGS. 6*a* and 6*b* illustrate adjustable orifice (19) placed aside from briefs midline, and where orifice 19 encircle penis in a way that prevents its falling out from separated space. Adjustable orifice (19) is placed left or right aside from brief's midline by rotating front inner insert (B') by 180° around the brief's midline. Additionally hems 17 and 18 have elastic means for adjustably encircling the penis, where, according to one embodiment of present invention, said elastic means can be tightened by the drawstring tightening means (21).

Figure 1:
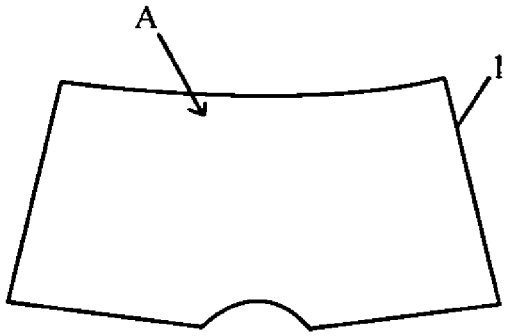
FIG. 1 shows the back and side panel of the briefs A.
Figure 2:
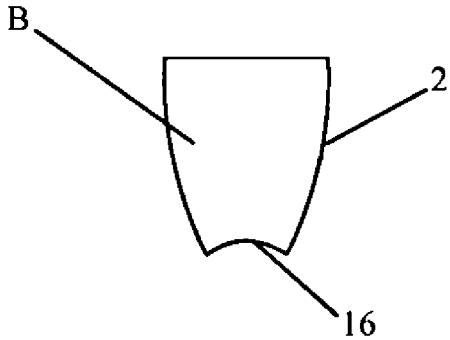
FIG. 2 shows the front outer insert B.
Figure 3:
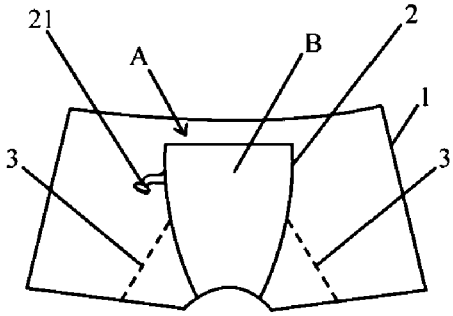
FIG. 3 shows the outer front view of the briefs.
Figure 4:
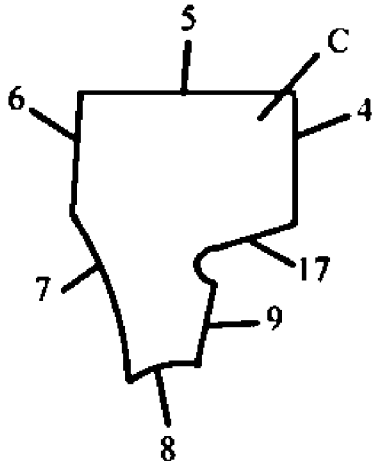
FIG. 4 shows view of the part C of the inner panel.
Figure 5:
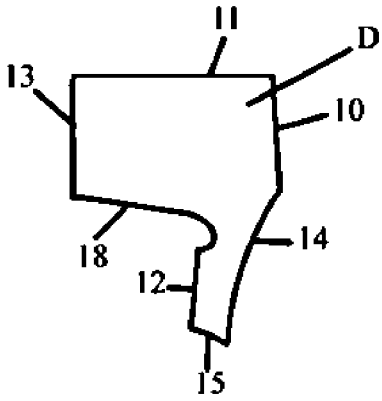
FIG. 5 shows view of the part D of the inner panel.
Figure 5B:
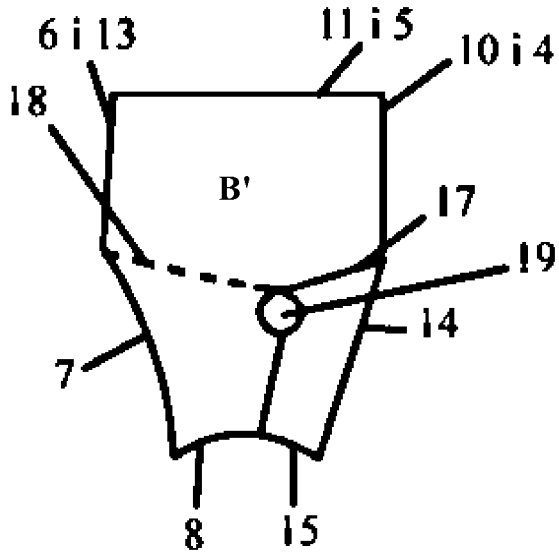
FIG. 5*b* shows view of the front inner insert B' according to another embodiment of the invention.
Figure 5A:
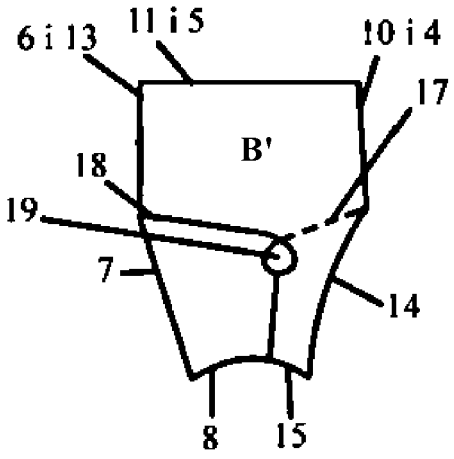
FIG. 5*a* shows view of the front inner insert B' according to the one embodiment of the invention.

As shown on FIGS. 4 and 5, front inner insert (B') is formed from two parts (C) and (D) with mutually sewed hems 5 and 11, 6 and 13, 8 and 15, 9 and 12, where curved hems 17 and 18 to form circular like adjustable orifice 19 for inserting penis into separated space, where orifice (19) is placed aside from briefs midline, wherein orifice 19 encircle penis in a way that prevents its falling out from separated space. With reference to the FIGS. 5*a* and 5*b*, front inner insert (B') being sewed with to the inner side of the outer panel (A) and front outer insert (B) at least through hem (7) and hem (14), and through sewing hem (8) and hem (15) to hem (16). Furthermore, inserts B and B' are connected to the outer panel (A) through hems (6 and 13), (10 and 4), (11 and 5) and (8 and 15). Outer panel (A) constitutes back, side and partially front side of briefs. Outer panel (A) can be tailored in one piece where that one piece includes part of the front panel (3). For person skilled in the art is obvious that certain modifications of the design of the outer panel (A) are possible without impact on the scope of the invention. For instance, outer panel A can be tailored from the more than one piece of fabrics (e.g. part (3) can be separate part of the briefs).

The men's briefs with separate space for the penis, according to this invention, eliminate deficiencies of known men's underwear with respect to their hygienic and health properties and physical discomforts. A separate space for the penis is situated at the inner side of front part of the briefs, between front outer insert and front inner insert. The above described briefs embodiment enables the testicles to retain their normal position between the legs, physically separated from the penis which is situated in a separate space, so that the penis neither presses, warms nor rubs the testicles. Regardless of the body movements and position, the penis will always remain in the separate space, which fully satisfies the essence and the function of the invention. The position and width of the penis space are adjusted to the sort, shape, cut and design of both the briefs as a whole and their particular parts. The function of the separate penis receiving space, however, remains unchanged.

What is claimed is:

1. Men's briefs with a separated space for a penis, made as short or long leg briefs, with a flexible belt, a panel, a front outer insert and a front inner insert, wherein the separated space for the penis is formed by the front outer insert and the front inner insert; the inserts being connectable to the panel in a manner to form the men's briefs, wherein the front inner insert has the same shape and dimensions as the front outer insert, wherein the front inner insert is formed from two overlapping sewed parts having curved hems, wherein the curved hems form a generally circular adjustable orifice for inserting the penis into the separated space, wherein the adjustable orifice is positioned offset to the left or right of a vertical midline of the briefs, and wherein the adjustable orifice encircles the penis in a way that prevents its falling out from the separated space.

2. Men's briefs according to claim 1, wherein the adjustable orifice is positioned to the left or right of the briefs' vertical midline by rotating the front inner insert by 180° around the briefs' vertical midline prior to being sewn to the panel or front outer insert.

3. Men's briefs according to claim 1, wherein the curved hems have an elastic means for adjustably encircling the penis.

4. Men's briefs according to claim 3, wherein the elastic means are tightened by a drawstring tightening means.

5. Men's briefs, said briefs having a separated space located in a forward portion thereof, said separated space comprised of an inner insert and an outer insert, said inner insert including two overlapping parts forming a generally circular adjustable orifice sized to permit a wearer to position a wearer's penis into the separated space, said adjustable orifice being positoned offset to the left or right of a vertical midline of the briefs and said adjustable orifice encircling the penis in a way that prevents its falling out from the separate space.

6. Men's briefs according to claim 5, wherein the adjustable orifice is positioned prior to being sewn to the outer insert by rotating the front inner insert by 180° around the briefs' vertical midline during assembly.

7. Men's briefs according to claim 5, wherein the inner insert and outer insert have the same shape and dimensions.

8. Men's briefs according to claim 5, wherein the briefs have short legs or long legs.

9. Men's briefs according to claim 5, wherein the generally circular adjustable orifice comprises a drawstring for tightening.

10. Men's briefs according to claim 5, wherein the generally circular adjustable orifice is defined by curved elastic hems.

* * * * *